United States Patent [19]

Pav

[11] 4,389,933

[45] Jun. 28, 1983

[54] CALENDER

[75] Inventor: Josef Pav, Krefeld, Fed. Rep. of Germany

[73] Assignee: Kleinewefers GmbH, Krefeld, Fed. Rep. of Germany

[21] Appl. No.: 232,197

[22] Filed: Feb. 6, 1981

[30] Foreign Application Priority Data

Feb. 9, 1980 [DE] Fed. Rep. of Germany ..... 3004915

[51] Int. Cl.[3] ..... B30B 3/04

[52] U.S. Cl. ..... 100/162 B; 29/116 AD; 100/170

[58] Field of Search ..... 100/47, 162 R, 162 B, 100/163 R, 168–170; 29/113 AD, 116 R, 116 AD; 72/241, 245

[56] References Cited

U.S. PATENT DOCUMENTS

| | | | |
|---|---|---|---|
| 2,861,504 | 11/1958 | Kane | 100/170 X |
| 3,777,656 | 12/1973 | Müller | 100/163 A |
| 3,884,140 | 5/1975 | Christ et al. | 100/163 R |
| 3,948,166 | 4/1976 | Wenzel | 100/163 R |
| 4,074,624 | 2/1978 | Biörnstad et al. | 100/170 |
| 4,290,351 | 9/1981 | Pav et al. | 100/170 |
| 4,311,091 | 1/1982 | Pav et al. | 100/161 |
| 4,319,522 | 3/1982 | Marchioro et al. | 100/162 B |

*Primary Examiner*—Peter Feldman

*Attorney, Agent, or Firm*—Kontler, Grimes & Battersby

[57] ABSTRACT

A calender wherein the lowermost roll of the roll train has a hollow cylindrical member spacedly surrounding a shaft-like carrier whose end portions are mounted in bearings movable up and down along guide rails on the stand. The end portions of the cylindrical member contain inserts serving to confine the cylindrical member to vertical reciprocatory movements relative to the carrier. The cylindrical member further contains a battery of cylinder and piston units which maintain the cylindrical member in an upper end position relative to the carrier. Additional cylinder and piston units maintain the carrier in an upper end position relative to the stand by urging shoulders which are provided on the bearings against stationary stops on the stand. The inserts prevent vibration of the cylindrical member relative to the carrier and the carrier is held against vibration relative to the stand because the stops for the bearings are disposed at one side of the vertical plane including the axis of cylindrical member and the axes of plungers forming part of the additional cylinder and piston units whereby the bearings jam against the respective guide rails. The distance through which the cylindrical member can descend relative to the carrier plus the distance through which the carrier can descend relative to the upper rolls suffices to provide room for removal of any selected roll from the stand. Further cylinder and piston units are provided to bias the uppermost roll of the train toward the roll therebelow.

20 Claims, 6 Drawing Figures

Fig. 2
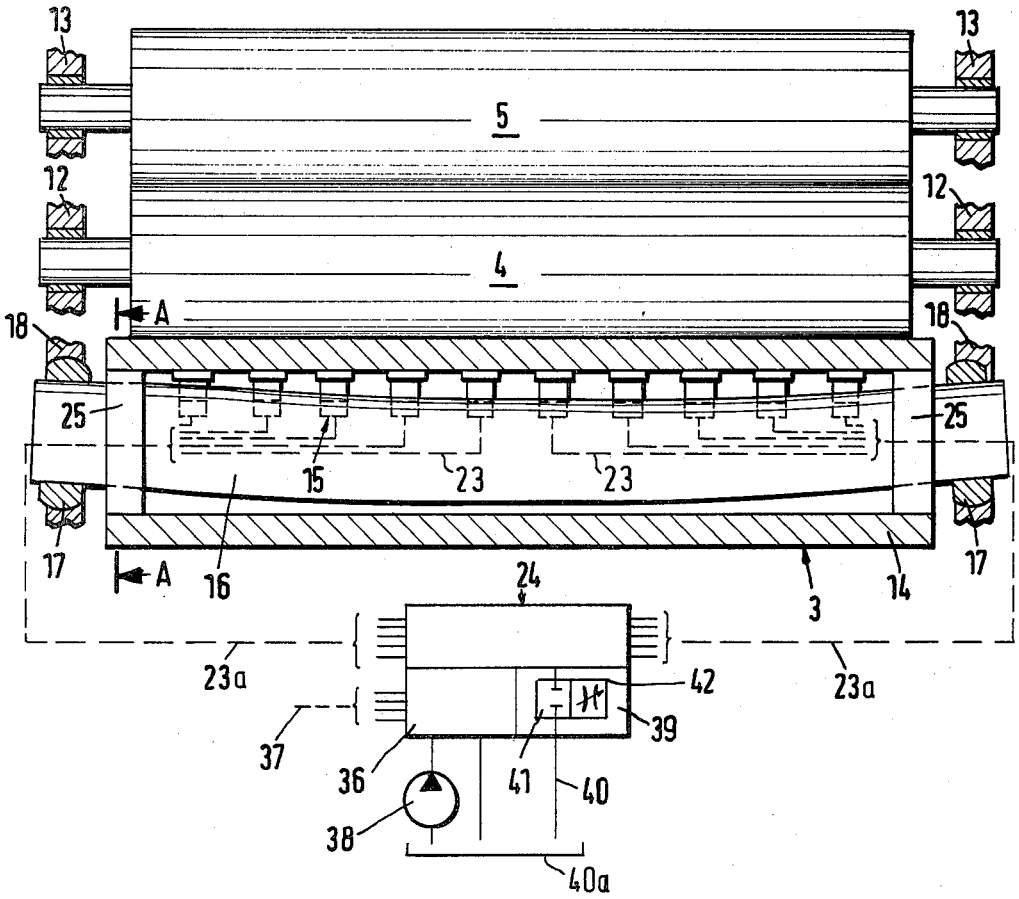
Fig. 3
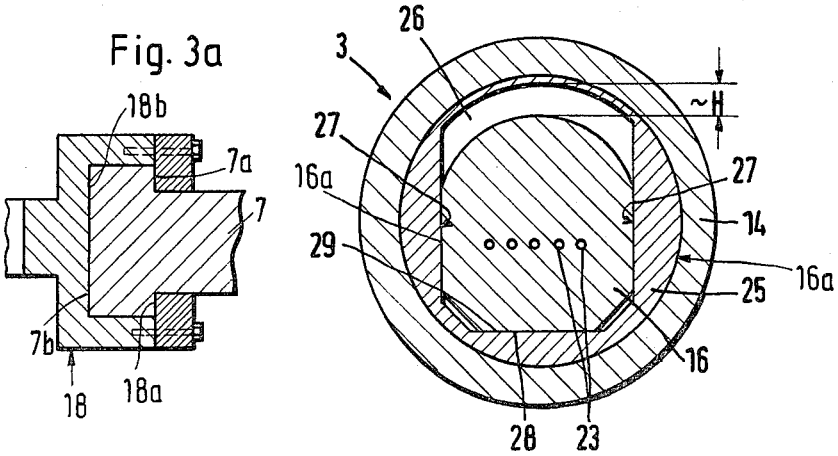
Fig. 3a

CALENDER

BACKGROUND OF THE INVENTION

The present invention relates to calenders in general, and more particularly to improvements in calenders of the type wherein the train of rolls comprises at least two superimposed rolls, wherein the lowermost roll has a hollow cylindrical member which surrounds a carrier mounted in bearings which are movable up and down along the roll stand, and wherein the carrier is held against angular movement in or with its bearings. Still more particularly, the invention relates to improvements in calenders wherein the cylindrical member of the lowermost roll is movable relative to its carrier by hydrostatic displacing means controllable by a regulating unit which causes the displacing means to compensate for flexure of the cylindrical member in actual use of the calender.

German Auslegeschrift No. 22 54 392 discloses a calender wherein the hollow cylindrical member of the lowermost roll cooperates with the roll which is disposed immediately thereabove and is mounted in a pair of bearings, the same as the carrier for the cylindrical member of the lowermost roll. The cylindrical member surrounds a displacing means including a row of cylinder and piston units which are staggered with reference to each other, as considered in the axial direction of the cylindrical member. The pressure of fluid in the cylinder chambers of such units must suffice to compensate for the weight of the cylindrical member, for the weight of any intermediate rolls if the train of rolls consists of three or more rolls, for any and all stresses which develop as a result of transport of a web of material to be treated through the calender, as well as to compensate for the tendency of certain portions of the cylindrical member to flex and to thereby change the profile of the nip between the lowermost roll and the roll immediately thereabove. Since the pressure of fluid in the cylinder chambers of the cylinder and piston units in the interior of the cylindrical member depends on a host of variable parameters, the regulation of such pressure presents many problems, especially since each and every change in stressing of the cylindrical member entails a change of fluid pressure in the aforementioned cylinder chambers because each such change in stress upon the cylindrical member can cause the cylindrical member to flex and to thus vary the width of the gap between its peripheral surface and the peripheral surface of the roll immediately above the lowermost roll. Each change of fluid pressure influences the load upon the cylindrical member, i.e., changes of fluid pressure in order to compensate for flexing of the cylindrical member can necessitate additional changes of fluid pressure in order to compensate for the changing load upon the cylindrical member as a result of those pressure changes which were carried out in order to prevent undue flexing of the cylindrical member. Moreover, the cylindrical members of presently known calender rolls which are constructed and assembled in the above outlined manner float on their carriers and, therefore, such cylindrical members exhibit a pronounced tendency to vibrate when the calender is in use.

OBJECTS AND SUMMARY OF THE INVENTION

An object of the invention is to provide a calender wherein at least one roll of the roll train has a hollow cylindrical member which is rotatable on a stationary carrier and wherein the cylindrical member is less prone to vibration than in heretofore known calenders.

Another object of the invention is to provide the calender with novel and improved means for regulating the pressure of means which serves to displace the hollow cylindrical member relative to its carrier.

An additional object of the invention is to provide a calender roll wherein a hollow cylindrical member spacedly surrounds a stationary carrier and the cylindrical member is less likely to vibrate, while cooperating with the neighboring roll of the calender to treat a running web of paper, textile material or the like, than in heretofore known calenders.

A further object of the invention is to provide novel and improved means for regulating and limiting the movements of the hollow cylindrical member relative to its carrier.

Still another object of the invention is to provide a calender with novel and improved means for effecting or allowing movements of the lowermost roll of the roll train to a position in which any selected roll of the train can be removed from the stand.

A further object of the invention is to provide the calender with novel and improved means for operatively connecting the end portions of the hollow cylindrical member with the corresponding portions of the carrier for such cylindrical member.

Another object of the invention is to provide a novel and improved lowermost roll for use in the roll train of a supercalender or a like machine.

Still another object of the invention is to provide a calender roll which can be installed in certain existing calenders as a superior substitute for heretofore known rolls.

One feature of the invention resides in the provision of a calender roll which comprises an elongated carrier which is non-rotatably mounted in bearings movable up and down along suitable guide means of the stand, a hollow cylindrical member spacedly surrounding the carrier, and means for rotatably mounting the cylindrical member on the carrier. The mounting means comprises at least one insert which is interposed between the cylindrical member and the carrier. The cylindrical member is rotatable on the insert and the insert is reciprocable with respect to the carrier in the radial direction of the cylindrical member. The carrier and the insert or inserts include cooperating confining portions (e.g., parallel vertical surfaces on the insert and complementary parallel vertical surfaces on the carrier) which restrict the insert and the cylindrical member to vertical reciprocatory movements relative to the carrier. Furthermore, the insert and the carrier comprise cooperating abutment means for limiting the extent of upward movement of the cylindrical member and the insert relative to the carrier. Such abutment means may include first and second surfaces which are respectively provided on the carrier and the insert, and the roll further comprises fluid-operated displacing means (e.g., one or more rows of hydraulic cylinder and piston units in the interior of the cylindrical member) for urging the second surface against the first surface when the roll is in actual use, i.e., for urging the cylindrical member to an upper end position relative to the carrier.

Another feature of the invention resides in the provision of a calender which embodies the aforediscussed roll and further comprises at least one additional roll above the cylindrical member of the first mentioned roll and means for biasing the additional roll downwardly toward the cylindrical member. The biasing means preferably comprises one or more fluid-operated motors which act upon the bearings for the additional roll and urge the latter vertically or nearly vertically downwardly toward the cylindrical member or against an intermediate roll of the calender if the roll train of the calender consists of more than two rolls.

The novel features which are considered as characteristic of the invention are set forth in particular in the appended claims. The improved calender itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a fragmentary front elevational view of the calender with the lowermost roll of the train shown in partial sectional view and further showing a portion of the control system for the hydraulic components of the machine;

FIG. 3 is an enlarged sectional view as seen in the direction of arrows from the line A—A in FIG. 2;

FIG. 3*a* is a horizontal sectional view as seen in the direction of arrows from the line B—B of FIG. 1;

DESCRIPTION OF THE PREFERRED EMBODIMENTS

Figure 1:
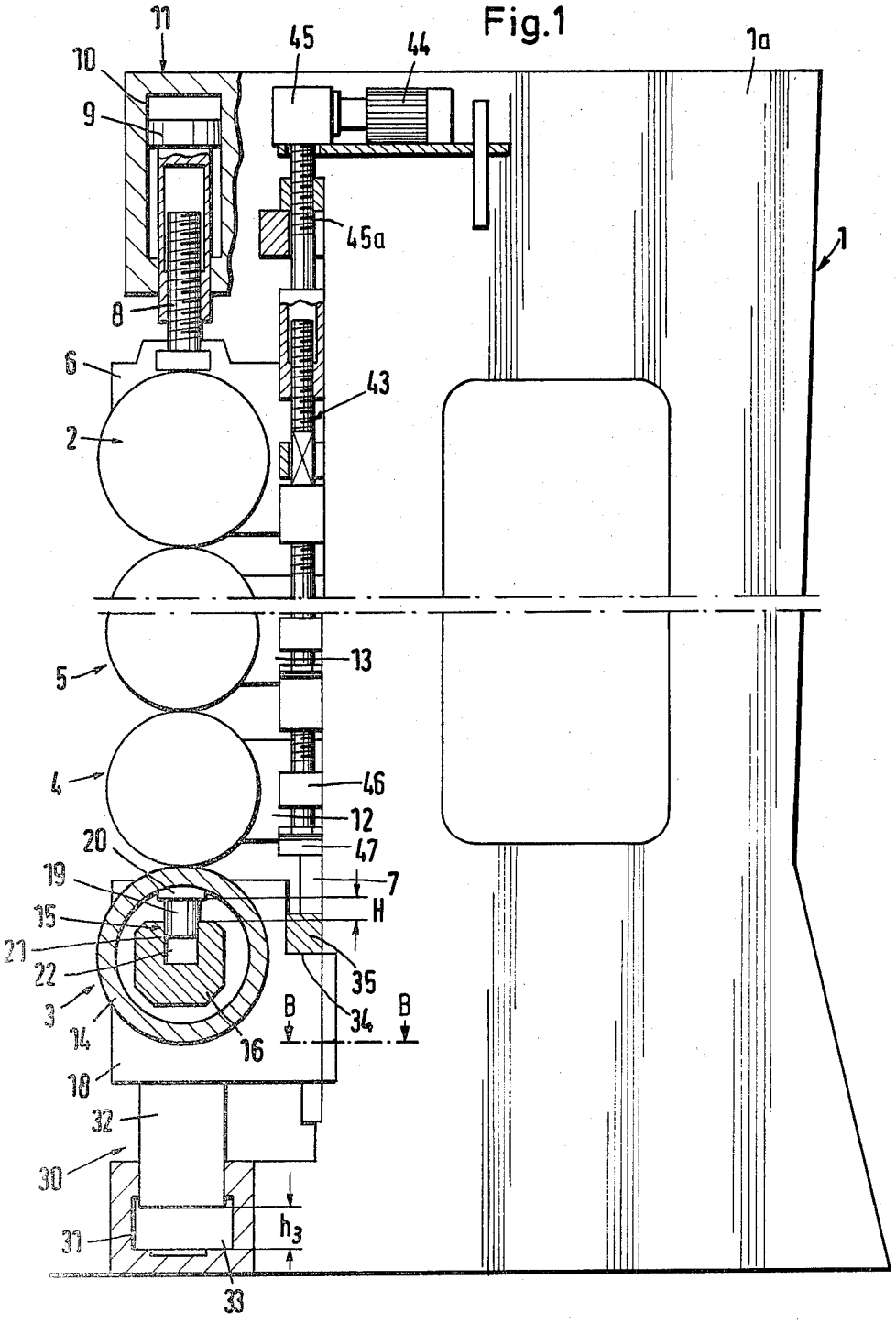
FIG. 1 is a fragmentary partly side elevational and partly sectional view of a calender which embodies one form of the invention.

The calender which is shown in FIG. 1 comprises a stand 1 having two spaced-apart vertical side parts or uprights 1*a* only one of which can be seen. The stand 1 supports a train of superimposed horizontal rolls including an uppermost or outermost roll 2, a lowermost or outermost roll 3 and at least one but preferably several intermediate rolls of which two, namely, the intermediate rolls 4 and 5, are shown in FIG. 1. The two end portions of the uppermost roll 2 are mounted in discrete bearings 6 (only one can be seen in FIG. 1) which are movably guided by the respective uprights 1*a*, namely, by vertical guide means in the form of rails or ribs 7 provided on the uprights. Each bearing 6 is suspended at the lower end of a discrete adjusting rod 8 which is coaxial with a piston 9 in the chamber of a cylinder 10 forming part of a hydrostatic cylinder and piston unit or motor 11 constituting one component of a hydraulic biasing means for the roll 2. The calender comprises two biasing means 11, one on each of the two uprights 1*a*, and these biasing means urge the roll 2 downwardly toward the roll 3. The end portions of the intermediate roll 4 are mounted in two discrete bearings 12 (see also FIG. 2) which are guided on the rails 7 of the corresponding uprights 1*a*, and the end portions of the intermediate roll 5 are mounted in a pair of analogous bearings 13.

The lowermost roll 3 comprises a hollow cylindrical member 14 which is movable up and down with as well as relative to an elongated carrier 16. The member 14 further surrounds a displacing means including a row of cylinder and piston units 15 which cooperate with the carrier 16 to maintain the member 14 in an optimum position relative to the nearest roll 4 and to thus ensure that the width of the nip of the rolls 3 and 4 is constant. The end portions of the carrier 16 are provided with annular bearing elements 17 which are tiltably mounted in the respective bearings 18 for the lowermost roll 3. The member 14 can rotate on the carrier 16 but the latter is held against rotation in the bearings 18.

Each of the cylinder and piston units 15 which together constitute the means for displacing the cylindrical member 14 relative to the carrier 16 comprises a plunger 19 the upper end portion of which is secured to a head 20 bearing against the internal surface of the member 14. The lower portion of each plunger 19 extends into a discrete cylinder 21 forming part of the carrier 16 and defining a cylinder chamber 22 at the underside of the plunger 19. The carrier 16 is formed with channels 23 which constitute extensions of pressure lines 23*a* for admission of oil or another suitable pressurized fluid into the chambers 22 for the purpose of preventing undue deformation of the member 14 or for promoting selective deformation of this member in order to ensure that the width of the nip of the rolls 3 and 4 will remain constant from the one to the other axial end of each of these rolls. The flow of pressurized fluid into and the evacuation of fluid via pressure lines 23*a* is controlled by a pressure regulating unit 24 (see FIG. 2).

The end portions of the cylindrical member 14 surround annular inserts 25 whose cylindrical external surfaces are complementary to the cylindrical internal surfaces of the respective end portions of the member 14. The opening or bore 26 of each insert 25 is bounded by two parallel vertical internal confining surfaces 27 which are adjacent to complementary parallel external confining surfaces or facets 16*a* of the carrier 16. The surfaces 16*a* and 27 cooperate to confine the inserts 25 to vertical reciprocatory movement with the member 14, i.e., relative to the carrier 16. The surface 16*a* and 27 enable the inserts 25 to move up and down (between upper and lower end positions) relative to the respective end portions of the carrier 16, i.e., the end portions of the member 14 are also free to move up and down with reference to the corresponding end portions of the carrier 16. The surfaces 29 which bound the bottom portions of the openings 26 in the inserts 25 can move into abutment with complementary external surfaces or facets 29 of the carrier 16 to limit the extent of vertical movement of the member 14 in one direction.

The bearings 18 for the lowermost roll 3 are movable up and down along the vertical guide rails 7 of the respective uprights 1*a*. As disclosed in the commonly owned copending application Ser. No. 230,022 filed Jan. 30, 1981, now U.S. Pat. No. 4,347,784, by Pav et al. for "Bearings for calender rolls and supports therefor", and as shown in FIG. 3*a* each of the rails 7 can have a T-shaped cross-sectional outline and extends into a complementary groove of the respective bearing 18 so that the latter can slide up and down along the respective rail 7 when the lowermost roll 3 is to be moved sideways (i.e., transversely of its axis) with or relative to the adjacent intermediate roll or rolls. The guides 7 can form integral parts of or are rigidly secured to the respective uprights 1*a*.

The lowermost roll 14 can be lifted by a pair of hydraulic motors here shown as cylinder and piston units 30 each of which supports one of the bearings 18 and one of which is shown in FIG. 1. The stationary cylinder 31 of each unit 30 defines a chamber 33 for admission of pressurized fluid against the lower end face of a vertical plunger 32 which supports the corresponding bearing 18 for the lowermost roll 3. Each bearing 18 has a portion or shoulder 34 which can be moved against a stop 35 secured to the respective upright 1*a* so that the bearings 18 are held at a predetermined uppermost level when the cylinder chambers 33 receive pressurized fluid to maintain the shoulders 34 in abutment with the respective stops 35.

FIG. 1 further shows that the stops 35, the corresponding shoulders 34 and the rails 7 are disposed at one side (namely, at the right-hand side, as viewed in FIG. 1) of the common vertical plane of the axes of the plungers 19 and 32. This means that, when the cylinder chambers 33 receive pressurized fluid to urge the shoulders 34 against the respective stops 35, the lower portions of internal surfaces 18*a* of the bearings 18 bear against the adjacent surfaces 7*a* of the rails 7 and the upper portions of internal surface 18*b* of the bearings 18 bear against the adjacent surfaces 7*b* of the rails 7 to thereby cause the bearings 18 to "jam" and hold the carrier 16 against undesirable movements relative to the stand 1. In other words, when the units or motors 30 urge the shoulders 34 against the respective stops 35 of the stand 1, the bearings 18 tend to turn about the respective portions of the rails 7 and thereby urge their internal surfaces 18*a*, 18*b* against the respective surfaces 7*a*, 7*b* of the rails 7 with the result that the stops 35 hold the bearings 18 against movement beyond the illustrated upper end positions and the bearings 18 are also held against any other movement, especially in a horizontal direction, due to clamping engagement with the rails 7. In fact, the aforementioned mounting of stops 35 and shoulders 34 as well as of rails 7 at one side of the common plane of the axes of plungers 19 and 32 further ensures that the bearings 18 are held against any movement in the axial direction of the cylindrical member 14 because the surfaces 18*a*, 18*b* are in strong frictional engagement with the adjacent surfaces 7*a*, 7*b* of the corresponding rails 7 to prevent the bearings 18 from moving axially of the cylindrical member 14 when the pressurized fluid in the chambers 33 urges the shoulders 34 against the adjacent stops 35. This means that, by the simple expedient of placing the parts 34, 35 and 7 at one side of the aforediscussed plane, admission of highly pressurized fluid into the chambers 33 entails stoppage of the bearings 18 in their upper end positions, stoppage of bearings 18 against any movement transversely of the rails 7 and at right angles to the axis of the cylindrical member 14, as well as against any movement in the axial direction of the cylindrical member 14.

The pressure regulating unit 24 comprises a regulating section 36 (FIG. 2) which receives signals from several conductors 37 to regulate the pressure of fluid which is supplied by a pump 38 or another suitable source of pressurized fluid in dependency on the intensity and/or other characteristics of the signals. The signals 37 are generated by suitable sensors (not shown) which monitor the position of the member 14, and the conduits 23*a* then supply pressurized fluid to the cylinder chambers 22 of the units 15 in such a way that the member 14 is held against flexing, i.e., that the width of the nip of the rolls 3 and 4 is constant. The pressure of fluid which is supplied (by the pump 38 or another source) to the cylinder chambers 33 is selected in such a way that it suffices to enable the lowermost roll 3 to remain in the preselected position (in which the shoulders 34 abut against the respective stops 35) by overcoming the combined weight of the rolls 2, 4, 5 thereabove as well as the pressure of fluid in the cylinder chambers of the hydrostatic units 11 serving to urge the uppermost roll 2 downwardly.

The units 15 in the interior of the member 14 ensure that the member 14 is lifted relative to the carrier 16 so that the surface 29 of each insert 25 bears against the complementary surface 28 on the corresponding end portion of the carrier 16. The position of the carrier 16 is fixed because the bearings 18 for its end portions (see FIG. 2) maintain their shoulders 34 in contact with the respective stops 35. Consequently, when the calender is in use, the position of the lowermost roll 3 is defined with a high degree of accuracy, on the one hand because the stops 35 define the positions of the respective bearings 18 and because the units 15 define the positions of axially spaced portions of the member 14 relative to the carrier 16. The units 15 counteract the tendency of the member 14 to flex and to thereby change the width of the nip between the rolls 3 and 4. The aforementioned sensors which transmit signals via conductors 37 shown in FIG. 2 can be constructed and mounted in a manner as disclosed in the commonly owned copending application Ser. No. 097,961 filed Nov. 28, 1979 by Pav et al, now U.S. Pat. No. 4,290,353. Compensation for changes in configuration of the member 14 (as a result of regulation of pressure in the chambers 22) does not influence the load upon the rolls and vice versa. Moreover, the structure which is shown in FIGS. 1 to 3*a* reduces the tendency of the rolls to vibrate, especially the tendency of the lowermost roll 3, because the inserts 25 constitute operative (force-locking) connections between the member 14 and the carrier 16, and the connection between the carrier 16 and the stand 1 (via bearings 18) is analogous.

The hollow cylindrical member 14 and the inserts 25 can be said to constitute a composite sleeve of the lowermost roll 3. A portion (14) of this sleeve can rotate about the carrier 16 and the surfaces 16*a*, 27 confine the sleeve to reciprocatory movements relative to the carrier (namely, to vertical movements radially of the member 14 between upper and lower end positions through a distance H corresponding to the extent to which the member 14 and its inserts 25 can move up and down relative to the carrier). The surfaces 28 and 29 constitute a means for limiting the extent of upward movement of the sleeve with respect to the carrier 16. The extent to which the units 30 can move the bearings 18 from the lower end positions to the upper end positions shown in FIG. 1 is indicated at $h_3$.

It is preferred to select the distance H in such a way that it exceeds, by at least 100 percent, the combined width of gaps between neighboring rolls of the roll train when such rolls are moved apart. However, the distance H normally does not suffice to allow for convenient removal of a selected roll from the stand 1. The combined distance $H+h_3$ is sufficient to permit for such removal of a given roll as well as to permit convenient reinsertion of the removed roll or the insertion of a substitute roll.

Figure 4:
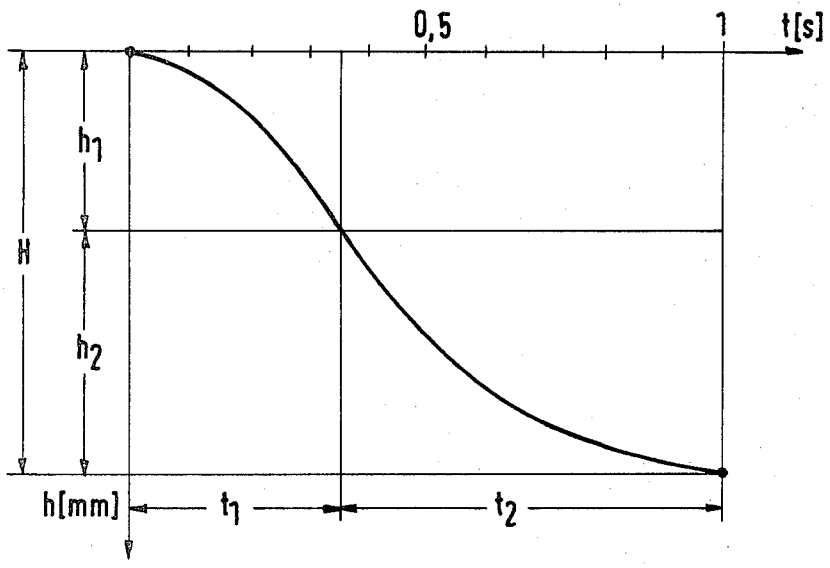
FIG. 4 is a diagram showing the rate of lowering of the lowermost roll of the train as a function of time.

The regulating unit 24 further comprises a portion 39 which is operable to lower the lowermost roll 3 relative to the stand 1. The portion 39 controls the flow of pressurized fluid from the cylinder chambers 22 and 33 into the sump 40*a* through a return line or conduit 40 shown in FIG. 2. The flow of fluid through the conduit 40 can be regulated by a combined shutoff valve 41 and adjustable flow restrictor 42. The valve 41 is closed when the lowermost roll 3 is to remain in its operative (upper end) position. At such time, the flow restrictor 42 is out of register with the conduit 40. When the regulating portion 39 of the unit 24 receives a suitable signal denoting that the lowermost roll 3 should descend, the flow restrictor 42 is adjusted to offer a relatively low resistance to the flow of fluid into the sump 40*a* so that the first stage (see the distance $h_1$ in the diagram of FIG. 4) of downward movement of the roll 3 is completed within a relatively short interval ($t_1$) of time. The distance (in millimeters) is measured along the ordinate and the time (in seconds) is measured along the abscissa of the coordinate system shown in FIG. 4. The next-following interval $t_2$ of downward movement of the roll 3 is the braking interval during which the speed of the roll 3 is gradually reduced by continuously increasing the throttling action of the flow restrictor 42. The distance which the roll 3 covers during the interval $t_2$ of braking is indicated at $h_2$. The combined distance $h_1+h_2=H$ corresponds to the maximum extent of movement of the member 14 relative to the carrier 16. An advantage of the just described mode of lowering the roll 3 is that the separation of this roll from the nearest roll 4 can be completed within a surprisingly short period of time (such period equals interval $t_1$) and that the roll 3 is not damaged because the last stage (interval $t_2$) of the movement of its cylindrical member 14 to the lower end position relative to the carrier 16 involves gradual deceleration of the member 14 to zero speed. The first portion of such period (interval $t_1$) serves for practically unrestricted descent of the member 14 in a direction away from the roll 4, and the next portion ($t_2$) serves for gradual deceleration of the member 14 until the member 14 reaches the lower end of its downward stroke relative to the carrier 16. Reference may also be had to the commonly owned copending application Ser. No. 083,632 filed Oct. 11, 1979 by Pav et al. for "Method and apparatus for rapidly separating the rolls of a calender", now U.S. Pat. No. 4,290,351. As long as the chambers 22 of the units 15 receive pressurized fluid, the surfaces 28 of the carrier 16 continue to abut against the surfaces 29 of the respective inserts 25. The total stroke H suffices to effect the necessary separation of the rolls 3 and 4 in the event of breakage of a web which is treated by the roll train.

The bearings 6 for the uppermost roll 2 and the bearings 12, 13 for the intermediate rolls 4 and 5 are suspended on two suspending units 43 which are mounted on the respective uprights 1*a* and each of which comprises a prime mover 44 (e.g., a reversible electric motor), a transmission 45 and a one-piece or a composite feed screw 45*a*. The uprights 1*a* are provided with suitable abutments 47 for nuts 46 meshing with the feed screws 45*a*. The nuts 46 are provided on the respective bearings 6, 12 and 13. By operating the motors 44, the attendant can simultaneously move all of the bearings 6, 12 and 13 up or down. If the feed screws 45*a* consist of discrete sections or screws which are movable axially relative to each other, the position of each bearing 6, 12 or 13 can be adjusted relative to the other bearings in the region of the respective upright 1*a*. Reference may be had to commonly owned U.S. Pat. No. 3,948,166 granted Apr. 6, 1976 to Wenzel for "Device for separating the rollers of a calender". The patented system constitutes but one of many means which can be used to move the bearings for the uppermost and intermediate rolls of a calender together with as well as relative to each other through predetermined distances. The sum of such distances is less than one-half of H.

If a roll of the roll train is to be removed from the stand 1, the attendant causes the member 14 of the lowermost roll 3 to descend relative to the carrier 16 and the attendant also causes the bearings 18 and the carrier 16 to descend relative to the stand 1. Lowering of the bearings 18 with the carrier 16 takes place in response to evacuation of pressurized fluid from the cylinder chambers 33 of the two cylinder and piston units 30. As explained above, the corresponding stroke $h_3$ (see FIG. 1) is relatively short, i.e., it normally does not suffice to allow for convenient removal of a roll from the stand 1. However, the sum of the strokes H and $h_3$ (i.e., the stroke $h_1+h_2+h_3$) suffices for convenient dismantling of any roll of the train of rolls which include the members 2, 3, 4 and 5. As explained above, the stroke H ($h_1+h_2$) equals the maximum extent of movement of the member 14 relative to the carrier 16 and bearings 18.

An important advantage of the improved calender is that the abutment surfaces 28 and 29 on the carrier 16 and inserts 25 cooperate to limit the extent of upward movement of the cylindrical member 14 relative to the carrier. When the calender is in use, the cylinder chambers 22 are filled with pressurized fluid so that the surfaces 29 of the two inserts 25 continuously abut against the complementary surfaces 28 of the carrier 16, i.e., the member 14 is continuously held in the upper end position with respect to the carrier. Such construction enables the motors 11 to accurately adjust the pressure between the neighboring rolls of the roll train, i.e., to select any one of a large number of different pressures without in any way affecting the flexure-preventing action of the units 15 upon the cylindrical member 14 of the lowermost roll 3. Thus, the aforementioned sensors which transmit signals via conductors 37 shown in FIG. 2 can cause the regulating unit 24 to compensate for or counteract eventual flexure of the member 14 while the end portions of the member 14 remain in the upper end positions with respect to the carrier 16. Thus, adjustments of pressure in the chambers 22 beyond that pressure which is needed to maintain the member 14 in the upper end position so that the surfaces 29 of the inserts 25 abut against the complementary surfaces 28 cannot affect the pressure between the neighboring rolls of the roll train, i.e., the pressure which the rolls exert upon a web of paper or other material which is treated in the calender. All that counts is to ensure that the pressure of fluid in the chambers 22 suffices to resist the force which is attributable to the combined weight of the rolls 2, 4 and 5, the force which is generated by the motors 11, and the force which is attributable to the action of treated material upon the rolls. As explained above, such pressure of fluid in the chambers 22, combined with that fluid pressure in the chambers 33 which suffices to maintain the bearings 18 in abutment with the stops 35, ensures that the lowermost roll 3 is invariably held in a predetermined position with reference to the stand 1 and with reference to other rolls of the roll train.

The inserts 25 prevent the cylindrical member 14 from floating relative to the carrier 16 so that the member 14 is much less likely to vibrate than in heretofore known calenders. Moreover, the aforediscussed mounting of the bearings 18 on the rails 7 (so that the bearings 18 are held against any movement relative to the stand 1 when their shoulders 34 bear against the respective stops 35 under the action of fluid pressure in the cylinder chambers 33) further reduces the likelihood of vibration of the cylindrical member 14 relative to the uprights 1*a* of the stand 1.

Eventual changes in the combined height of all rolls in the stand 1 (e.g., those changes which are attributable to surface treatment of the rolls when the need for such treatment arises) can be compensated for by the motors 11 so that the retention of the bearings 18 in predetermined positions relative to the stand 1 and the retention of the cylindrical member 14 in a predetermined (upper end) position relative to the carrier 16 does not present any problems in view of the need for intermittent treatment of the rolls. Such retention of the lowermost roll 3 in a predetermined position relative to the stand 1 and retention of the cylindrical member 14 in a predetermined position relative to the carrier 16 ensures that the distances which the lowermost roll 3 and its member 14 must cover in order to allow for removal of a given roll from the stand remain unchanged. Thus, the entire distance H can be used to allow for removal of a given roll from the stand 1 as soon as the motors 30 have permitted the bearings 18 to assume their lower end positions with respect to the uprights 1*a*. A single adjustment of the positions of stops 35 relative to the corresponding uprights 1*a* suffices to ensure that the axis of the cylindrical member 14 is horizontal whenever the lowermost roll 3 assumes its operative position, and the same holds true for adjustment of all other rolls for the purpose of maintaining their axes in parallelism with the axis of the member 14. This applies in spite of the fact that the rolls 2, 4, 5 are movable relative to each other in order to increase the width of gaps between neighboring rolls.

The provision of inserts 25 and their surfaces 27, 29 constitutes a very simple and inexpensive solution of the problem of preventing floating of the cylindrical member 14 relative to the carrier 16 and the resulting problems owing to vibratory and/or other stray movements of the cylindrical member when the calender is in use.

Another advantage of the improved calender is that the extent to which the motors 30 must allow the bearings 18 to move to their lower end positions with respect to the stand 1 is relatively small because the cylindrical member 14 can be lowered relative to the carrier 16 in order to provide room for removal of a selected roll from the stand 1. In other words, in the absence of a possibility to lower the member 14 relative to the carrier 16 (preferably simultaneously with movement of the bearings 18 away from the bearings 12 for the roll 4), the distance $h_3$ shown in FIG. 1 would have to be selected with a view to allow for removal of a roll from the stand. In view of the movability of the cylindrical member 14 through the distance H, neither the distance H nor the distance $h_3$ must be sufficiently large to allow for removal of a roll; all that counts is that the combined distance $H+h_3$ at least equals that distance which is needed to allow for removal of a roll or for reinsertion of the removed roll (or for insertion of a fresh roll) when the cylindrical member 14 assumes its lower end position with respect to the carrier 16 and the bearings 18 assume their lower end positions with reference to the guides 7. The just discussed feature is of particular importance in calenders wherein the space is at a premium, e.g., in a conventional calender wherein a customary lowermost roll of the roll train is to be replaced with a roll (3) which embodies the present invention.

It is possible to provide the shoulders 34 or equivalent abutment means on the motors 30. The placing of such shoulders on the bearings 18 renders it possible to dispose the shoulders, as well as the corresponding stops 35, at one side of the vertical plane including the axes of the plungers 32. This brings about the aforediscussed advantages, i.e., jamming of the bearings 18 in their upper end positions to further reduce the likelihood of vibration of the cylindrical member 14 by preventing any stray movements of the carrier 16 relative to the stand 1. At the same time, the bearings 18 are still free to move between their upper and lower end positions in order to allow for removal of a selected roll from the stand provided that the cylindrical member 14 is also moved to its lower end position with respect to the carrier 16.

Figure 5:
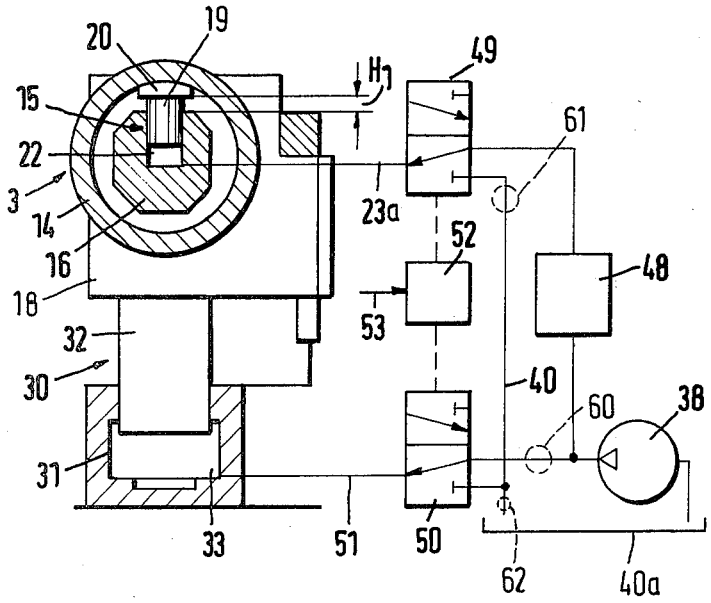
FIG. 5 is a fragmentary partly vertical sectional and partly diagrammatic view of a modified calender.

FIG. 5 illustrates a portion of a modified calender wherein all such parts which are identical with or clearly analogous to corresponding parts of the calender shown in FIGS. 1 to 3 are denoted by similar reference characters. One of the differences between the two calenders is that the stroke $H_1$ (the extent of movement of the member 14 relative to the carrier 16) is shorter than the stroke H. The pump 38 can admit pressurized fluid into the conduits 23*a* and thence into the channels 23 (not shown in FIG. 5) leading to the cylinder chambers 22 by way of a pressure regulating device 48 and a switchover (two-position) valve 49. Furthermore, the pump 38 delivers pressurized fluid into the cylinder chambers 33 by way of a switchover or two-position valve 50. The conduits which convey fluid from the valve 50 to the cylinder chambers 33 are denoted by the reference character 51. It will be noted that FIG. 5 merely shows a single switchover valve 50 and a single conduit 51; however, it is equally within the purview of the invention to provide a discrete valve 50 for each of the two cylinder and piston units 30. If desired or necessary, a pressure reducing valve 60 (indicated by a broken-line circle because it is optional) can be installed between the outlet of the pump 38 and the switchover valve or valves 50. Each of the valves 49, 50 may constitute a solenoid operated valve.

A control unit 52 (e.g., an amplifier) is operatively connected with the switchover valves 49 and 50 and receives signals by way of conductor means 53. When the conductor means 53 transmits a signal, the control unit 52 causes the valving elements of the valves 49 and 50 to change their positions so that the return conduit 40 can connect the cylinder chambers 22 and 33 with the sump 40*a*. Lowering of the member 14 relative to the carrier 16 is completed when the undersides of the heads 20 for the plungers 19 reach and bear against the upper side of the carrier 16, and the downward movement of the bearings 18 for the lowermost roll 3 is terminated thereafter, namely, when the lower end face of each plunger 32 comes into abutment with the bottom surface of the respectively cylinder 31 (i.e., when the plungers 32 complete their downward strokes through the distances $h_3$). It will be seen that the regulating system of FIG. 5 ensures that the interval which is required to move the cylindrical member 14 from the upper end position to the lower end position relative to the carrier 16 (distance $H_1$) is different from (preferably shorter than) the interval which elapses during movement of the bearings 18 from their upper end positions to their lower end positions relative to the stationary guide means. This is achieved by appropriate dimensioning of the channels 23, conduits 23*a*, 51 and appropriate selection of the throttling action of the valves 49 and 50. Alternatively, the same result can be achieved if the conduit 40 contains a first flow restrictor 61 which regulates the rate of flow of fluid from the cylinder chambers 22 into the sump 40*a* and a second flow restrictor 62 which regulates the flow of fluid from the cylinder chambers 33 into the sump 40*a*. The flow restrictors 61, 62 (indicated by broken-line circles because optional) ensure that the chambers 22 are emptied ahead of the chambers 33.

The improved calender can be modified in a number of ways without departing from the spirit of the invention. For example, the single row of cylinder and piston units 15 can be replaced with two or more rows, e.g., in a manner as disclosed in the commonly owned copending application Ser. No. 196,123 filed Oct. 10, 1980 by Pav Et al. for "Roll for use in calenders or the like, now U.S. Pat. No. 4,328,744. If the single row of units 15 is replaced with two or more rows, the distribution of units 15 is preferably such that the resultant force acts in or close to the vertical plane including the axis of the member 14. Furthermore, the confining surfaces 27 which cooperate with the surfaces 16*a* to hold the inserts 25 against rotation on the carrier 16 can be replaced by hydrostatically operated guide pistons. Still further, the single regulating unit 24 of FIG. 2 can be replaced with several discrete regulating units each of which controls the pressure in a single cylinder and piston unit 15 or in a smaller group of cylinder and piston units. Reference may be had to FIGS. 6 and 7 of the aforementioned commonly owned copending application Ser. No. 196,123 filed by Pav et al. It is equally possible to replace the entire row of cylinder and piston units 15 with a device which comprises at least one plenum chamber extending all the way between the two uprights 1*a* of the stand 1. Such plenum chamber can be flanked by strips or the like and is filled by pressurized hydraulic fluid to hold the sleeve 14 against undue deformation. The lower hydrostatic cylinder and piston units 30 can be replaced by mechanical supporting and moving units for the bearings 18 of the lowermost roll 3, e.g., by feed screws which are rotatable by motors to move the bearings 18 up or down. Finally, it is equally possible to replace the upper hydrostatic cylinder and piston units 11 with one or more rows of cylinder and piston units (corresponding to the units 15) if the uppermost roll 2 is designed in a manner similar to or corresponding to that of the lowermost roll 3, i.e., if the roll 2 also comprises a hollow cylindrical member surrounding a carrier whose end portions are mounted in the bearings 6 or analogous bearings. The discrete cylinder and piston units in the interior of the uppermost roll (if such roll resembles the roll 3) can be replaced with the aforediscussed elongated plenum chambers. The pressure in the regulating section 36 of the regulating unit 24 or in the regulating device 48 might be controlled in a usual manner by valves as is disclosed in German Offenlegungsschrift No. 25 55 677. The signal on conductor means 53 might be a separating signal, which is delivered from a detector when the calendered web has been ruptured.

The combined shutoff valve 41 and adjustable flow restrictor 42 is commercially available. For example, it may be a proportional valve of the type known as WRZ 25 manufactured and sold by G. L. Rexroth, Lohr-/Main, Federal Republic Germany, which is controlled by an amplifier of the type known as VT-3000 (also manufactured and sold by Rexroth) and actuated by a separating signal. Reference may be had to data sheets RD 29914/1-78 and RD 29382/2-78 and to the pamphlet entitled "Technik von Rexroth", 4 WRZ (pages 48, 49) which describe and illustrate the aforementioned valves and the amplifier of Rexroth.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a calander, the combination of a stand having a pair of spaced apart upright guide means; a train of superimposed rolls in said stand, said rolls including an uppermost roll and a lowermost roll, said lowermost roll including a carrier non-rotatably mounted in said stand and a rotary sleeve surrounding said carrier and movable thereon radially toward and away from an upper end position, said carrier having first and second end portions respectively adjacent said first and second guide means and further comprising first and second bearings for the respective end portions of said carrier, said bearings being movable up and down along the corresponding guide means, said sleeve and said carrier having cooperating abutment means engaging each other in the upper end position of said sleeve; fluid-operated displacing means provided in said sleeve and operative to normally urge said sleeve to said upper end position; and means for biasing said uppermost roll toward said sleeve.

2. The combination of claim 1, wherein said biasing means comprises at least one fluid-operated motor.

3. The combination of claim 1, wherein said sleeve includes a hollow cylindrical member and at least one insert rotatably installed in said member, one of said abutment means being provided on said insert.

4. The combination of claim 1, further comprising means for biasing said bearings to predetermined upper end positions.

5. The combination of claim 4, wherein said means for biasing said bearings comprises fluid-operated motor means.

6. The combination of claim 1, wherein said sleeve is movable relative to said carrier between said upper end position and a lower end position through a first distance which is less than a second distance necessary to allow for removal of one of said rolls from said stand, said bearings being movable relative to said guide means between said upper end positions and lower end positions through a third distance which, combined with said first distance, at least equals said second distance.

7. The combination of claim 4, wherein said stand comprises stop means for arresting said lowermost roll in the upper end positions of said bearings and said means for biasing said bearings to said upper end positions comprises at least one fluid-operated motor.

8. The combination of claim 7, wherein said bearings include portions which abut against said stop means in the upper end positions of said bearings.

9. The combination of claim 7, wherein said motor includes a plunger and said stop means is disposed only at one side of the plane including the axis of said plunger.

10. The combination of claim 1, wherein said train includes at least three rolls and the rolls above said lowermost roll are movable relative to said lowermost roll to define between themselves and with said sleeve a plurality of gaps having a predetermined combined width, said sleeve being movable relative to said carrier through a distance which is at least twice said predetermined width.

11. The combination of claim 10, further comprising a source of pressurized fluid and means for regulating the flow of fluid to and from said displacing means whereby said sleeve descends from said upper end position when said regulating means allows the fluid to flow from said displacing means, said regulating means comprising means for throttling the flow of fluid from said displacing means at a relatively low first rate during a first stage of movement of said sleeve from said upper end position and at a relatively high second rate during the remaining stage of downward movement of said sleeve relative to said carrier.

12. The combination of claim 11, wherein the distance which said sleeve covers during said first stage at least approximates said combined width.

13. The combination of claim 1, wherein said carrier is movable relative to said stand between upper and lower end positions and said displacing means comprises at least one first fluid-operated motor, and further comprising at least one second fluid operated motor for moving said carrier between said upper and lower end positions, a common source of pressurized fluid for said motors, control means for simultaneously initiating the discharge of fluid from said motors to thereby effect the movement of said sleeve from the upper end position relative to said carrier and the movement of said carrier from the upper end position relative to said stand, and means for regulating the discharge of fluid from said first and second motors so that the interval of movement of said sleeve relative to said carrier is different from the interval of movement of said carrier relative to said stand.

14. The combination of claim 13, wherein said first mentioned interval is shorter than said last mentioned interval.

15. In a calender, the combination of a support; a stack of superimposed rolls with an uppermost and lowermost roll as well as at least one intermediate roll, the lowermost roll comprising a carrier which is non-rotatably mounted in the support and a rotary shell which surrounds the carrier and is movable relative thereto radially through a first distance between an upper and a lower end position, said carrier being movable relative to the support over a second distance between an upper and a lower end position; abutment means being provided for the shell and the carrier which cooperate with each other and which engage each other in the upper end position of the shell; at least one first fluid operated motor which stresses the uppermost roll in a direction toward the lowermost roll; pressurized fluid actuated shifting means provided in the shell and actuable to move the shell between its upper end position and its lower end position by permitting pressure medium to escape; cooperating abutment means for the carrier and the support which are adapted to engage each other in the upper end position of the carrier; at least one second fluid operating motor actuatable to move the carrier to its lower end position by permitting medium to escape; a source of pressurized fluid; and a control device for the shifting means with a throttling device which throttles the flow of escaping pressure medium a small amount during the first stage of the downward movement of the shell relative to the carrier and a much greater amount during the following remaining stages, wherein said uppermost roll and at least one intermediate roll are associated with stops which determine the width of predetermined gap between the aforementioned rolls as a result of lowering of the shell and, further, wherein said first distance is smaller than a third distance which is required to permit dismanteling of a roll from the support but at least twice the fourth distance which is required to establish a predetermined separation gap between all of the rolls, said second distance being smaller than said third distance and the sum of the first and second distances being at least as great as the third distance.

16. The calender of claim 15 further including a common pressure source for said shifting means and said second fluid operating motor.

17. The calender of claim 16 further including a control device which permits the simultaneous escape of pressure medium so that the downward movement of the shell is effected as a result of relative movement between the shell and the carrier and between the carrier and the support.

18. In a calender, the combination of a stand; a train of superimposed rolls in said stand, said rolls including an uppermost roll and a lowermost roll, said lowermost roll including a carrier non-rotatably mounted in said stand and a rotary sleeve surrounding said carrier and movable thereon radially toward and away from an upper end position and movable relative to said stand between upper and lower end positions, said sleeve and said carrier having cooperating abutment means engaging each other in the upper end of said sleeve; fluid-operated displacing means provided in said sleeve and operative to normally urge said sleeve to said upper end position, said displacing means comprising at least one first fluid-operated motor, and further comprising at least one second fluid operated motor for moving said carrier between said upper and lower end positions, a common source of pressurized fluid for said motors, control means for simultaneously initiating the discharge of fluid from said motors to thereby effect the movement of said sleeve from the upper end position relative to said carrier and the movement of said carrier from the upper end position relative to said stand; and means for biasing said uppermost roll toward said sleeve.

19. The combination of claim 18, wherein said displacing means further includes means for regulating the discharge of fluid from said first and second motors so that the interval of movement of said sleeve relative to said carrier is different from the interval of movement of said carrier relative to said stand.

20. The combination of claim 19, wherein said first mentioned interval is shorter than said last mentioned interval.

* * * * *

UNITED STATES PATENT AND TRADEMARK OFFICE

CERTIFICATE OF CORRECTION

PATENT NO. : 4,389,933

DATED : June 28, 1983

INVENTOR(S) : Josef PAV

It is certified that error appears in the above-identified patent and that said Letters Patent are hereby corrected as shown below:

Col. 10, Line 55, "respectively" should read --respective--;
Col. 14, Line 40, after "end", --position-- should be inserted.

Signed and Sealed this

*Eighth* Day of *October 1985*

[SEAL]

*Attest:*

DONALD J. QUIGG

*Attesting Officer*

*Commissioner of Patents and Trademarks—Designate*

UNITED STATES PATENT AND TRADEMARK OFFICE

CERTIFICATE OF CORRECTION

PATENT NO. : 4,389,933

DATED : June 28, 1983

INVENTOR(S) : Josef PAV

It is certified that error appears in the above-identified patent and that said Letters Patent are hereby corrected as shown below:

Col. 14, line 1, "operating" should read --operated--.
Col. 14, line 15, "dismanteling" should read --dismantling--.
Col. 14, line 23, "operating" should read --operated--.
Col. 14, line 36, "and" should read --, said carrier being--.

Signed and Sealed this

*Eighth* Day of *April 1986*

[SEAL]

*Attest:*

DONALD J. QUIGG

*Attesting Officer*

*Commissioner of Patents and Trademarks*